United States Patent [19]

Klamer

[11] Patent Number: 4,699,432

[45] Date of Patent: Oct. 13, 1987

[54] DUAL MATERIAL SAFETY WHEEL

[76] Inventor: Reuben B. Klamer, 100 Coast, Apartment #207, La Jolla, Calif. 92037

[21] Appl. No.: 794,672

[22] Filed: Nov. 4, 1985

[51] Int. Cl.[4] ..... A63C 17/22

[52] U.S. Cl. ..... 301/5.3; 152/210; 152/212

[58] Field of Search ..... 301/5.3, 5.7; 152/210, 152/211, 324, 325, 323, 212

[56] References Cited

U.S. PATENT DOCUMENTS

| | | | |
|---|---|---|---|
| 322,611 | 7/1885 | Jones et al. | 301/5.3 |
| 1,087,682 | 2/1914 | Pratt | 152/212 |
| 2,485,304 | 10/1949 | Marsh | 301/5.3 |
| 2,878,071 | 3/1959 | Fowlkes | 301/5.3 |
| 4,135,763 | 1/1979 | Kosono et al. | 301/5.7 |
| 4,208,073 | 6/1980 | Hechinger | 301/5.3 |

FOREIGN PATENT DOCUMENTS

| | | | |
|---|---|---|---|
| 1031192 | 5/1958 | Fed. Rep. of Germany | 301/5.3 |
| 30102 | 11/1910 | United Kingdom | 301/5.3 |

*Primary Examiner*—David A. Scherbel
*Attorney, Agent, or Firm*—Irell & Manella

[57] ABSTRACT

A safety wheel has on the surface thereof a tread design comprised of a relatively hard material which defines interstitial spaces, which spaces are filled with a relatively soft material. The overall surface of the resulting safety wheel is substantially smooth, while the softer material filling the interstitial spaces absorbs unevenness in a surface traversed by the wheel. In embodiments where the interstitial spaces are generally circular in nature, a suction force is created by interaction between the surface traversed, the soft material filling the interstitial spaces, and the hard material immediately defining the interstitial spaces. This suction force provides greater traction for the wheel on the traversed surface, thereby enhancing the safety of the wheel. Other non-circular interstitial space shapes are disclosed. The broader features of this invention (i.e. use of two materials having different densities to form a tread design of hard material defining interstitial spaces filled with softer material) are applicable to virtually to any type of tire or wheel. Particular embodiments for roller skate or skateboard wheels are illustrated, while embodiments for automobile or bicycle tires are also possible within the scope of this invention.

15 Claims, 10 Drawing Figures

Fig. 1.
(PRIOR ART)
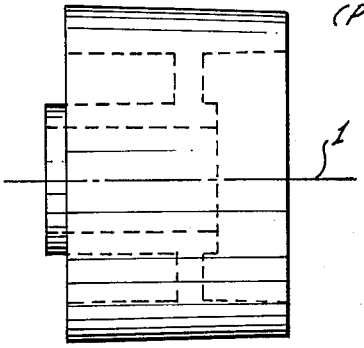
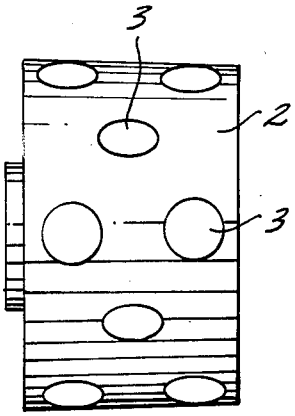
Fig. 2.
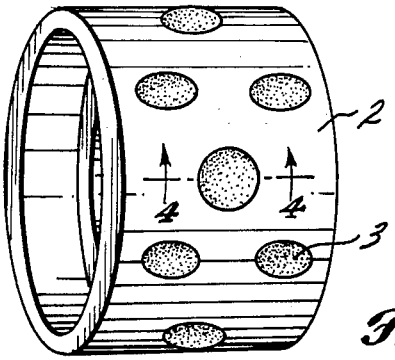
Fig. 3.
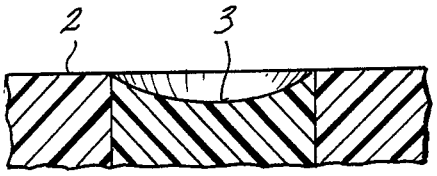
Fig. 4.

DUAL MATERIAL SAFETY WHEEL

BACKGROUND AND SUMMARY OF THE INVENTION

This invention concerns in general a safety wheel providing improved traction and performance. In particular, a circular wheel is integrally formed with a tread design on its surface, with the tread design defining interstitial spaces. The tread design portion of the wheel is formed with a relatively hard material, while the interstitial spaces are filled with a relatively soft material integrally bonded to the harder material. This provides an overall smooth surface for the wheel while the relatively soft material absorbs unevenness in surfaces traversed by the wheel. Also, the use of different materials on different portions of the wheel can provide enhanced performance and/or interesting visual effects.

Another feature of one embodiment of this invention is that the relatively soft material may fill the interstitial spaces so as to form a slightly cupped area, thereby providing a suction cup effect for the wheel with respect to surfaces traversed thereby.

Various attempts have been made by prior inventors to provide a wheel having enhanced safety by including particular stone rejection features or improved handling or wear characteristics. Examples of U.S. Pat. Nos. disclosing such inventions are:

| Inventor | U.S. Pat. No. | Issue Date |
|---|---|---|
| Heitfield | 4,070,065 | January 24, 1978 |
| Youngblood | 3,608,602 | September 28, 1971 |
| Hoke | 3,727,661 | April 17, 1973 |
| Hoke | 3,706,334 | December 19, 1972 |
| Hechinger | 4,208,073 | June 17, 1980 |
| Fowlkes | 2,878,071 | March 17, 1959 |
| Jones | 322,611 | July 21, 1885 |
| Board | 782,318 | February 14, 1905 |
| Okazaki | 4,385,653 | May 31, 1983 |
| Pierson | 4,478,266 | October 23, 1984 |

Heitfield discloses a particular wheel for use with skateboards and roller skates, wherein the wheel is a molded plastic wheel having a thin annular groove extending inwardly from its outboard end. The result is a resiliently yieldable and radially thin peripheral tread portion backed up by a thick relatively rigid band of material on the radially inward side of the groove. With such structure, Heitfield creates a soft wheel effect with a wheel of relatively hard plastic material.

Youngblood discloses a tire tread providing enhanced stone rejection. "Dimpled" mold insert blades are used to create relatively deep grooves having annular ridges and matching channels. The deep grooves enhance stone rejection while also permitting easier extraction of the tire from its mold.

Both Hoke patents are concerned with a tread design having grooves therein. The grooves have crossbar members at the bottom thereof which are integrally formed with the grooves themselves (i.e., all of the same one material). The grooves and the crossbars interact to capture and cradle stones therein so as to protect the remainder of the tire tread.

Hechinger discloses a wheel for skateboards made of a composite of low and high friction coefficient materials, i.e. urethane and rubber. The construction, however, requires a hub having projections to lock the rubber to the urethane.

Fowlkes discloses a laminated skate wheel having an inner annular softer portion disposed between two annular outer portions of a harder material. The various layers are fused together in a molding process. The purpose is to retain sufficient traction while obtaining increased wear characteristics.

Jones and Board disclose constructions which involve metal wheels having perforations or apertures into which a softer material is pressed.

Okazaki and Pierson disclose rubber tires formed of two different kinds of rubber, parallel strips in Okazaki and concentric strips in Pierson.

None of the prior art patents disclose a wheel having an interstitial construction of two different hardness materials in which the materials are integrally bonded to one another. Further, none of the prior art discloses an arrangement of a wheel using an interstitial construction of two different materials in which the two different materials can also be visually different, i.e. different colors, so as to obtain interesting visual and/or animation effects as the wheel rolls.

The present invention addresses these drawbacks and overcomes the same by utilizing two materials of different hardness (i.e., density) interstitially bonded in the fabrication of a whole. The harder of the two materials (i.e. the more dense) is used to form a tread design on the surface of the wheel. The less hard of the two materials (i.e. the less dense one) is then used to fill in interstitial spaces of the tread design in an integrally bonded relationship formed with the harder material. Additionally, the less hard material may be used to form the tread design, with the harder material filling in the interstitial spaces of the tread design. The overall surface of the resulting wheel is relatively smooth. However, the softer material filling the interstitial spaces of the tread design absorbs unevenness occurring in surfaces traversed by the wheel. Such unevenness might be caused by small stones or the like.

Furthermore, with some embodiments of the present invention, the interstitial spaces may be so formed by the tread design and filled with the softer material that a plurality of suction cup devices are formed on the surface of the wheel. These suction cup devices perform like any other suction cup to provide traction for the wheel on surfaces traversed thereby, especially when such surfaces are relatively smooth ones such as finished concrete.

Additionally, the two materials forming the interstitial construction may be provided with different visual characteristics, such as color, so as to obtain interesting visual and/or animation effects as the wheel rolls.

The features of this invention are applicable to virtually any type of tire or wheel, including but not limited to skateboard wheels, roller skates, bicycle tires, automobile tires and motorcycle tires.

BRIEF DESCRIPTION OF THE DRAWINGS

More detailed features of the present invention may be better understood by studying the following specification in conjunction with the accompanying drawings, in which:

FIG. 1 illustrates a PRIOR ART plastic or rubber roller skate wheel to which the present invention may be applied;

FIG. 2 illustrates one embodiment of the present invention applied to a roller skate wheel as in FIG. 1;

FIG. 3 is another view of the FIG. 2 embodiment;

FIG. 4 is an enlarged cross-section of a portion of FIG. 3 illustrating a slightly cup-shaped interstitial space thereof;

DETAILED DESCRIPTION OF THE PREFERRED EMBODIMENTS

Figure 5:
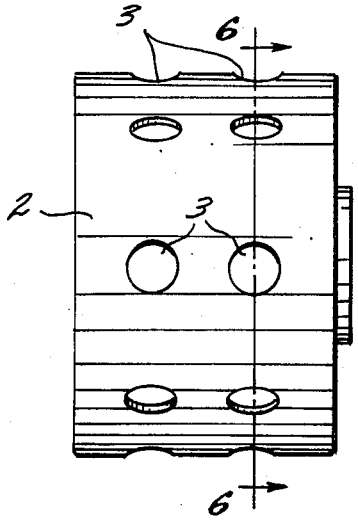
FIG. 5 illustrates another embodiment of the present invention.

FIG. 1 is a plan figure of a PRIOR ART roller skate wheel (such as the Fisher-Price pre-school roller skate wheel). The wheel is injection molded with a relatively high density (i.e., relatively hard) plastic material. The dotted line representations of FIG. 1 illustrate the formation of its rotational axis (shown with an axial line 1 therethrough). Injection molding processes are conventional and the FIG. 1 illustration is considered self-explanatory to one of ordinary skill in the art without further comment.

FIG. 2 illustrates a wheel in accordance with the present invention, with the same orientation thereof as the FIG. 1 illustration. The portions 2 of FIG. 2 are essentially a solid injection-molded tread design formed of a first material. This first material is a relatively dense or hard material, such as polyvinylidene chloride. An injection molding of this first (harder) material defines interstitial spaces 3 about the surface of the wheel.

These interstitial spaces are filled in accordance with the present invention with a second material in an integrally bonded relationship which is less dense (i.e., less hard) than the first material. This insert material may comprise polyurethane, for example. The overall surface of the resulting wheel is relatively smooth.

FIG. 3 is an illustration of the FIG. 2 embodiment with its axis tilted at a slight angle to the page. This figure further illustrates that the overall surface of the wheel is essentially smooth, and that the interstitial spaces 3 are filled with a different material from that used in the injection molding process which forms the tread design 2 integrally with the wheel. The conventional technique of dual nozzle injection molding (forcing heated materials in a liquid state into chilled molds for cooling and setting) may be used to form both the first material in the shape of a wheel with the indicated tread design and the second material which fills the interstitial spaces defined by the tread design.

The embodiment of FIGS. 2 and 3 illustrates interstitial spaces which are generally circular in shape as defined by the tread design. This circular shape can be especially useful in establishing a further feature of the present invention in accordance with one embodiment thereof. This further feature is better understood in conjunction with FIG. 4, which illustrates an enlarged cross-section of one interstitial space of FIG. 3.

As seen in the enlarged close up view of FIG. 4, the interstitial space 3 in accordance with this one embodiment is not filled so as to be precisely smooth with respect to the surface of tread design material 2, but instead is slightly cup-shaped. As the wheel rotates over a relatively smooth surface, this slightly cup-shaped filling is subjected to weight and depressed onto the ground surface. This causes air previously within this space formed by the cup shape to be evacuated, thereby creating a vacuum. Hence, the slightly cup-shaped interstitial space fillings of FIGS. 2 and 3 form a plurality of suction cups around the surface of the wheel which increases traction of the wheel to a surface traversed by the wheel.

Other orientations of the interstitial spaces as defined by the tread design are possible within the scope of the present invention. FIG. 5 shows one such example, wherein generally circular-shaped interstitial spaces are again used, but are formed in aligned rows of two interstitial spaces each. This is in comparison with the alternating rows of one and two spaces as shown in FIGS. 2 and 3. It is also possible within the scope of the present invention to form staggered rows of two spaces each.

FIG. 5 also illustrates the slightly cupped filling of interstitial spaces which feature of this invention provides the suction cup action discussed above. Four such slightly cupped interstitial filled spaces are particularly evident from the edges of the wheel in FIG. 5 illustration.

Figure 6:
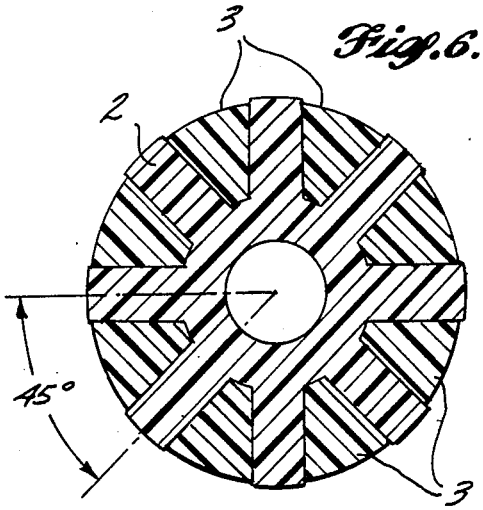
FIG. 6 is a cross-section of the FIG. 5 embodiment.

FIG. 6 is a cross-section of FIG. 5 along line 6—6 thereof. FIG. 6 illustrates the angular displacement of the interstitial spaces around the surface of the wheel. As there illustrated, at least a pair of interstitial spaces occur within every forty-five angular degrees around the surface of the wheel. Other angular displacements are, of course, possible within the scope of the present invention, but only the forty-five degree angle is illustrated here for the sake of simplicity.

Not only are various angular displacements and alignments of the interstitial spaces possible within the scope of the present invention, but different shapes of interstitial spaces are also a feature of this invention.

Figure 7:
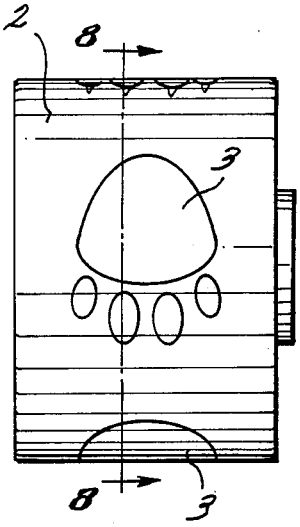
FIG. 7 is another embodiment of the present invention.

FIG. 7 illustrates one such alternative shape for interstitial spaces in accordance with the present invention. The interstitial spaces 3 of FIG. 7 are defined by the tread design material 2 so as to give the appearance of "tiger paws". By varying the size of the interstitial spaces and selectively grouping the same, the tiger paw appearance is created. Since the individual interstitial spaces defining such tiger paws are still generally circular, the suction cup feature of the present invention discussed above is also achieved with the FIG. 7 embodiment.

Figure 8:
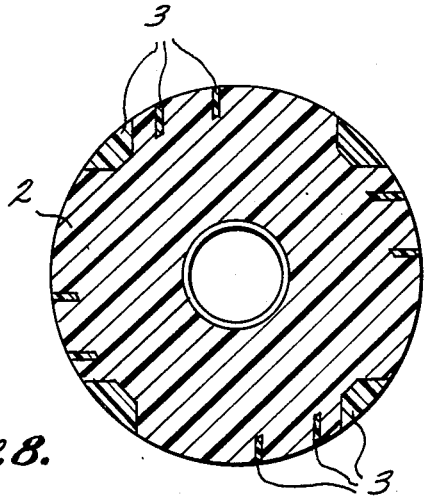
FIG. 8 is a cross-section of the FIG. 7 embodiment.

FIG. 8 illustrates a cross-section of the FIG. 7 embodiment along the line 8—8 thereof. FIG. 8 discloses to one of ordinary skill in the art the varying sizing and positioning of interstitial spaces 3 which are necessary to provide a surface appearance tiger paw.

Figure 9:
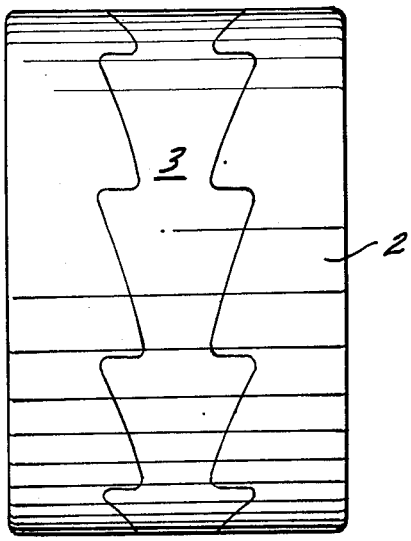
FIG. 9 is another embodiment of the present invention.

FIG. 9 illustrates yet another embodiment of the present invention, wherein all the interstitial spaces defined by the tread design material 2 are joined together to establish one single large interstitial space. This single space is shaped as a continuous chain of arrowheads with the point ends thereof truncated. Another way to visualize and understand the FIG. 9 embodiment is to consider the interstitial spaces as a series of triangles, with portions thereof overlapping. In this particular embodiment, it may also be advantageous to use polyamide in place of polyvinyledene chloride as the basic material for forming the tread design, while still using polyurethane as the integrally bonded filler in the interstitial space. It is to be understood that known equivalent materials may be used in place of the disclosed materials, in accordance with this invention. It should also be understood that other known molding techniques, such as rim molding, can be used to form the integrally bonded relationship between the two materials.

The FIG. 9 embodiment shares the features of this invention concerning an overall smooth surface of the wheel in combination with relatively softer interstitial spaces for absorbing unevenness in the surface traversed by the wheel. Further, an arrangement such as the FIG. 9 embodiment can provide enhanced performance characteristics when used by an experienced skater. For example, by an experienced skater shifting his or her weight so as to primarily bear on either the harder or softer portions of the wheel it would be possible to either skate faster or to do "trick" skating.

Figure 10:
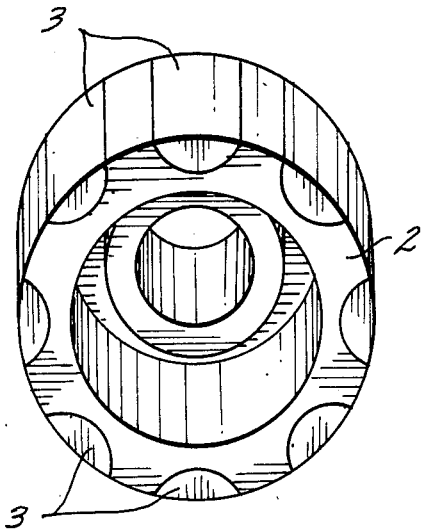
FIG. 10 is also another embodiment of the present invention.

The FIG. 10 embodiment is also yet another possible formation for the interstitial spaces as defined by the tread design. The interstitial spaces 3 illustrated there are substantially rectangular in shape on the surface of the wheel, with the longer sides of those rectangles being equivalent to the full width of the wheel surface.

Other modifications and variations to the present invention will be well understand by one of ordinary skill in the art while yet still falling within the broader teachings of this invention. For example, the circular-shaped interstitial spaces of FIG. 2 through 5 may be replaced with some other shapes, such as stars or squares. Also, geometric shapes may be replaced with other shapes such as animal profiles, for example a pony's head or whole body. Furthermore, different colors may be used for the various materials so as to enhance the aesthetic appeal of wheels incorporating this invention. Also, the wheels can be formed with two different materials integrally bonded to each other in the sides of the wheels, with the materials having different colors so as to achieve interesting visual effects as the wheels rotate.

Also, various angular displacements and arrangements of the interstitial spaces are possible within the scope of this invention. For example, while the diameter of the FIG. 5 circular interstitial spaces are substantially equal to 20% of the width of the wheel surface in the FIG. 5 embodiment, smaller or even larger diameter interstitial spaces are within the scope of this invention. All such modifications and variations occurring to one of ordinary skill in the art are intended to fall within the scope of the present invention, which is further limited only by the following claims.

What is claimed is:

1. A wheel comprising a circular wheel integrally formed with a tread design on the surface thereof, said tread design being formed by a relatively hard material and defining interstitial spaces, where said interstitial spaces are filled with a relatively soft material integrally bonded to the relatively hard material and wherein said interstitial spaces are filled with said relatively soft material so that the surface thereof is slightly cup-shaped, thereby defining a plurality of suction cups for providing said wheel with traction on surfaces traversed by the wheel, especially smooth surfaces such as finished concrete.

2. A wheel as in claim 1 wherein said relatively hard material comprises polyvinylidene chloride and has a higher density than said relatively soft material.

3. A wheel as in claim 1 wherein said relatively soft material comprises polyurethane and has a lower density then said relatively hard material.

4. A wheel as in claim 1 wherein said relatively hard material comprises polyamide and has a higher density than said relatively soft material.

5. A wheel as in claim 1 wherein said interstitial spaces are circular-shaped.

6. A wheel as in claim 5 wherein said interstitial spaces are formed on said wheel surface in alternating rows of one and two spaces.

7. A wheel as in claim 5 wherein said interstitial spaces are formed on said wheel surface in aligned rows of two spaces each.

8. A wheel as in claim 7 wherein at least one of said rows of spaces is positioned around said wheel surface every 45° thereof.

9. A wheel as in claim 7 wherein the diameter of each of said circular-shaped spaces falls within a range of 15% to 30% of the width of said wheel surface.

10. A wheel as in claim 5 wherein said interstitial spaces are formed on said wheel surface in staggered rows of two spaces each.

11. A wheel as in claim 1 wherein said interstitial spaces are tiger paw-shaped.

12. A wheel as in claim 1 wherein said interstitial spaces form a continuous chain of arrowheads with the tip portions thereof truncated.

13. A wheel as in claim 1 wherein said interstitial spaces are rectangular-shaped with the length of the longer sides of the rectangles being equal to the width of said wheel surface.

14. A wheel as in claim 1 wherein said wheel is adapted to fit on a roller skate.

15. A safety wheel made by the process of: providing two materials having different densities; and performing dual nozzle injection molding of said two materials so that the denser of the two forms a wheel having a substantially smooth surface with a tread design thereon defining interstitial spaces, and so that the less dense of the two fills said interstitial spaces; wherein said less dense material cushions unevenness in a surface traversed by said wheel: and where said interstitial spaces cooperate with said less dense material to induce suction cup action with respect to the traversed surface so as to provide traction for said wheel on a traversed surface.

* * * * *